US006561702B1

(12) United States Patent
Yik

(10) Patent No.: US 6,561,702 B1
(45) Date of Patent: May 13, 2003

(54) HOLDER FOR A PORTABLE DEVICE

(75) Inventor: Kai Chung Franco Yik, Hong Kong (CN)

(73) Assignee: Concord Camera Corp., Hollywood, FL (US)

( * ) Notice: Subject to any disclaimer, the term of this patent is extended or adjusted under 35 U.S.C. 154(b) by 0 days.

(21) Appl. No.: 10/061,436

(22) Filed: Feb. 1, 2002

(51) Int. Cl.[7] ..... G03B 17/00
(52) U.S. Cl. ..... 396/420; 218/689
(58) Field of Search ..... 396/419, 420; 248/689, 231.81, 200

(56) References Cited

U.S. PATENT DOCUMENTS 3,870,209 A * 3/1975 Mazur ..... 224/255
4,714,184 A * 12/1987 Young et al. ..... 224/673
4,901,852 A * 2/1990 King ..... 206/320
5,697,538 A * 12/1997 Goldenberg et al. ..... 224/676
D413,022 S * 8/1999 Tyneski et al. ..... D3/328
D413,435 S * 9/1999 Chapman et al. ..... D3/219
6,029,871 A * 2/2000 Park ..... 224/197
6,134,388 A * 10/2000 Balling et al. ..... 396/6
6,176,401 B1 * 1/2001 Lim ..... 224/196
6,188,881 B1 * 2/2001 Braxton ..... 455/351
6,357,641 B1 * 3/2002 Cheng ..... 224/242
6,435,690 B1 * 8/2002 Till ..... 362/88
6,445,881 B1 * 9/2002 Stiehler et al. ..... 396/6

* cited by examiner

*Primary Examiner*—Russell Adams
*Assistant Examiner*—Michelle Nguyen
(74) *Attorney, Agent, or Firm*—Scott L. Lampert; Kerry P. Sisselman

(57) ABSTRACT

A holder for a portable device is disclosed. The holder has a housing and garment attachment clip. The housing retains the portable device using three retaining arms, leaving the top open so that the portable device can be removed and replaced easily without obstruction. Further, an opening through the back of the housing permits a prong on the garment attachment clip to cooperate with a protuberance on the portable device to maintain the portable device more securely in the holder. If desired, the protuberance may additionally bias the prong away from the surface of the holder. This facilitates placement of the holder on a garment or belt. The holder may be styled to cooperate with additional surface features of the portable device for a close fit with the device.

21 Claims, 6 Drawing Sheets

HOLDER FOR A PORTABLE DEVICE

FIELD OF THE INVENTION

The present invention relates to the field of cameras, and more particularly, to a camera belt clip accessory and a camera adapted to interface therewith.

BACKGROUND OF THE INVENTION

As cameras and other portable devices become more compact, it is useful for the user to be able to carry them on the belt or waistband of a garment or other object, thereby making the camera or other portable device readily accessible as well as freeing the user's hands for other purposes. What is needed is a holder for a compact portable device which is easily attached to a belt, garment or other object and which maintains the portable device snugly in the holder.

SUMMARY OF THE INVENTION

The present invention relates to a holder for a portable device. The holder includes a housing and integral attachment clip. The housing retains the portable device using three retaining arms, each structured to grasp different sides of the portable device, leaving an opening so that the portable device can be removed and replaced easily without obstruction. Further, an opening through the back of the housing permits a prong on the attachment clip to protrude through such opening and cooperate with a mating structure, such as a protuberance or an indent, on the portable device to lock the portable device into the holder. The holder may be styled to cooperate with additional surface features of the portable device.

These and other objects and advantages of the present invention will become more readily apparent in the description that follows.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentality's disclosed. In the drawings.

DETAILED DESCRIPTION OF THE PREFERRED EMBODIMENTS

Figure 1:
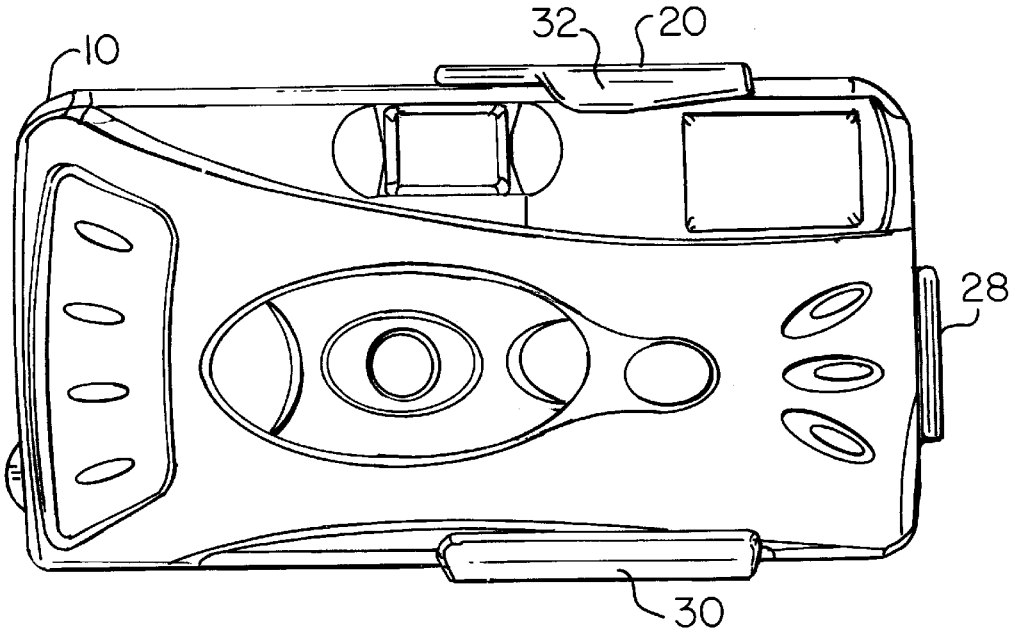
FIG. 1 is a front plan view of a camera housed in a belt clip in accordance with one embodiment of the present invention.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Referring now to FIGS. 1–10, there is shown a holder 20 with a clip for a portable device in accordance with a preferred embodiment of the present invention. The portable device may be a device such as a pager, cell phone or other portable device. In the preferred embodiment, the holder 20 is used to carry a camera 10. Since cameras are well known, the particular features and functions of the camera 10 will not be described herein, unless they relate specifically to a feature or function of the present invention.

Holder 20 includes a main body or back portion 22. The attachment clip 24 is fixed at the top 24*a* to the top of the back portion 22 of the holder 20. The bottom edge 24*b* of the attachment clip 24 is free to move, such that an article may be passed between the attachment clip 24 and the outer surface 22*a* of the back portion 22 of the holder 20. Further, the attachment clip 24 includes a prong 26 located proximal to the bottom edge 24*b* of the attachment clip 24.

Located at the bottom of the back portion 22 is the support foot 28. Support foot 28 extends out from the back portion of the holder 20 to provide a support for the portable device once inserted into the holder 20. If the back portion 22 of the holder 20 and the attachment clip 24 lay along an x-axis, support foot 28 is disposed generally perpendicular to the back portion 22 of the holder 20 along the y-axis. When the holder 20 is worn vertically on a belt of a user, the portable device will be forced against the support foot 28 by gravity. In one embodiment of the present invention, the support foot 28 is substantially the same width in the z-axis direction as the free end of the attachment clip and is aligned below the free end of the attachment clip. In one specific embodiment, the widths in the z-axis direction of both the attachment clip and the support foot are about ⅞ths of an inch.

Figure 5:
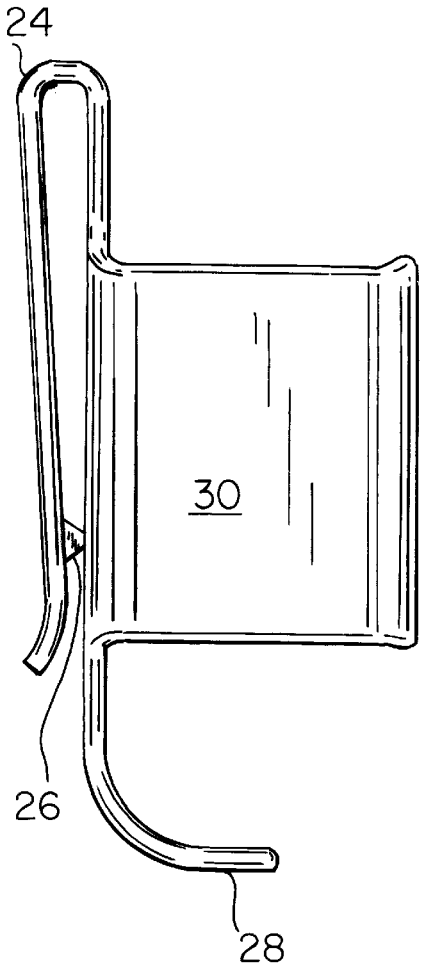
FIG. 5 is a left side plan view of the belt clip of FIG. 3.
Figure 6:
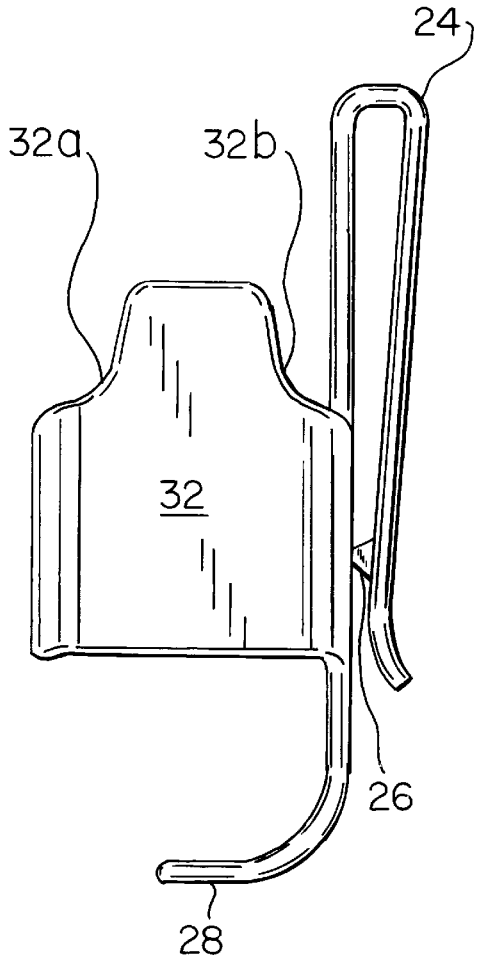
FIG. 6 is a right side plan view of the belt clip of FIG. 3.
Figure 7:
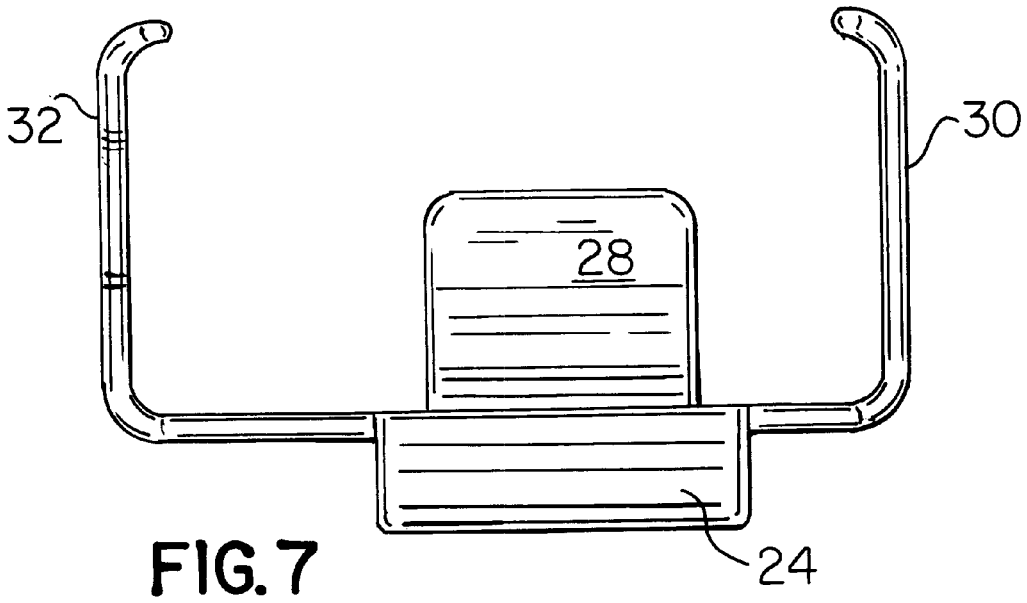
FIG. 7 is a top plan view of the belt clip of FIG. 3.
Figure 8:
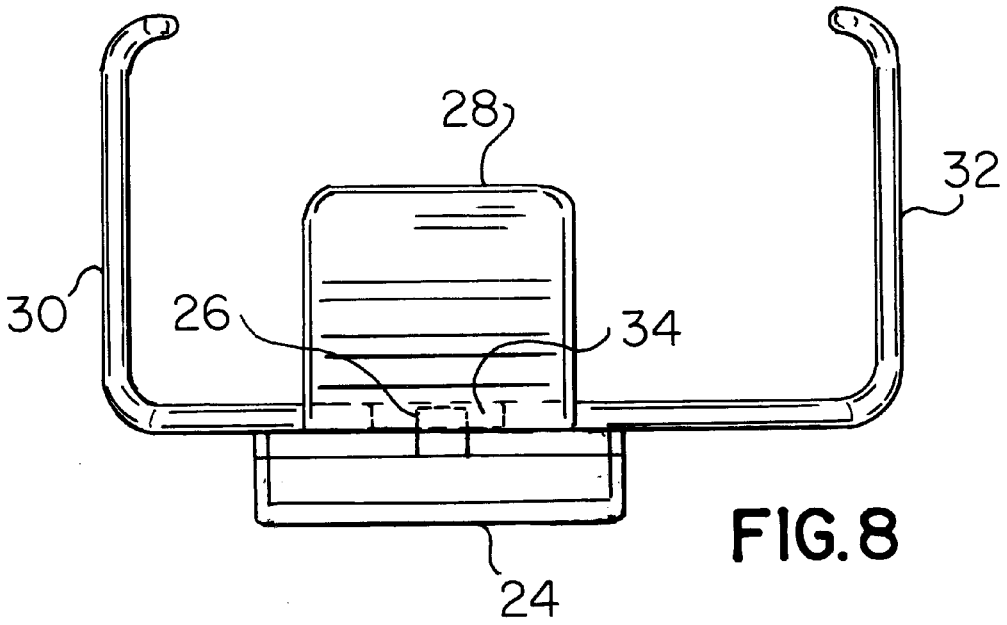
FIG. 8 is a bottom plan view of the belt clip of FIG. 3.

Additionally, if desired, instead of immediately coming off at a sharp right angle, the portion connecting the support foot 28 to the back 22 may gradually curve around to match the contour of the portable device, as shown in FIGS. 5 and 6.

The holder 20 additionally includes retaining arms 30 and 32, respectively. The retaining arms 30, 32 initially extend out from the body substantially perpendicular to the back portion 22 and the distal portion of the supporting arms curve back into almost parallel relationship with the back portion 22 of the holder. As such, the portable device will be retained in the holder and against the back portion 22 by the retaining arms 30, 32. The retaining arms 30, 32 may be separate and distinct members from the support foot 28.

Preferably, the back portion 22 and/or retaining arms 30, 32 may be sized and/or styled to closely fit the contours of the portable device and to not obstruct functional portions of the device. For example, in the preferred embodiment shown more particularly in FIGS. 1 and 2, the holder 20 is contoured to permit the rear viewfinder surface 18 of camera 10, which projects outwardly from the surface of the camera, to nestle into curve 22*c* formed into the back portion 22. Similarly, the retaining arm 32 includes cut away portions 32*a* and 32*b* to insure that the viewfinder is not obstructed and/or is sized so as not to obstruct the flash. This permits the camera to fit snugly into the holder 20, while permitting it to be used without removing the camera 10 from the holder 20.

Figure 10:
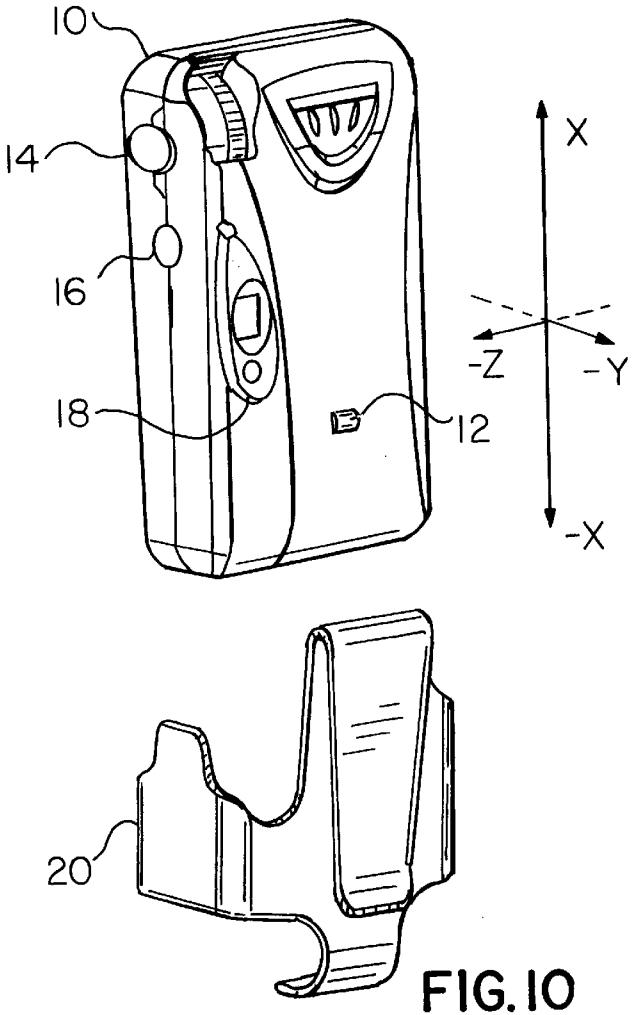
FIG. 10 is a rear perspective exploded view taken from the right side of a camera and belt clip in accordance with one embodiment of the present invention.

Further, the back portion 22 of the holder 20 includes an opening therethrough in a position corresponding to the prong 26 on the attachment clip 24. Referring more specifically to FIG. 10, there is shown a camera 10 to be carried in the holder 20. The camera 10 has been designed to include a mating structure, such as protuberance or nub 12. Alternatively, a different mating structure, such as an indent in the surface of the camera 10 that is aligned with the holder prong 26, may be used.

In the presently described embodiment, the nub 12 is sized and located to pass through the opening 34 in the back portion 22 of the holder 20 when the camera 10 is seated within the holder 20. The nub 12 is additionally located so that upon mating with the opening 34, the nub 12 contacts the prong 26. Further, after placement of the holder on a garment or other object, the prong 26 may still contact the nub 12, either directly or with a portion of the garment or other object disposed therebetween. Thus the nub 12 is maintained in the opening 34. Together, the prong 26, opening 34 and nub 12 act as a detent mechanism to lock the camera 10 in place in the holder 20 and resist forces that may act to shake it loose from the holder 20. If desired, the nub can be sized such that the prong contacting the nub 12 biases the open end of the attachment clip 24 away from the outer surface 22*a* of the holder 20. The resulting bias on the attachment clip 24 may make it easier to slide the attachment clip 24 over a belt or other garment or object.

Holder 20 is preferably integrally molded as a single piece from a resilient plastic material. However, this is not meant to be limiting. Rather the holder 20 can be made from multiple pieces joined together, or of other materials than resilient plastic.

Figure 9:
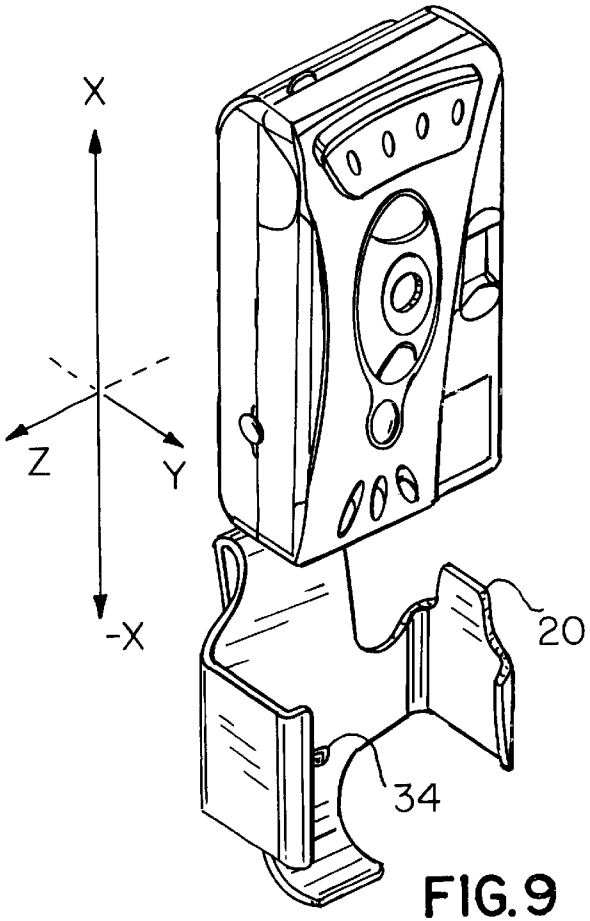
FIG. 9 is a front perspective exploded view taken from the left side of a camera and belt clip in accordance with one embodiment of the present invention.

Referring more specifically to FIGS. 9 and 10, there is shown the camera 10 and holder 20. In use, the camera 10 is slid into the holder 20 in the −x direction. Then the attachment clip 24 is slid over a belt or waistband of a garment or another object in the −x direction. When the holder is positioned vertically (wherein the attachment clip 24 lies along the x-axis) gravity will maintain the camera 10 in contact with the support foot 28 at the bottom of the holder. To take a picture, the user may remove the camera 10 from the holder 20 by sliding the camera 10 out of the holder 20 in the x direction while keeping the holder 20 on the garment or other object. Alternatively, the user may remove the camera 10 and holder 20 together, take a picture, and replace the camera 10 and holder 20, together, onto the belt, garment or other object. The detent mechanism of the preferred embodiment (prong 26 and opening 34 which cooperate with the nub 12) helps to maintain the camera 10 in the holder 20 together when removed as a unit from the belt, garment or other object.

Figure 2:
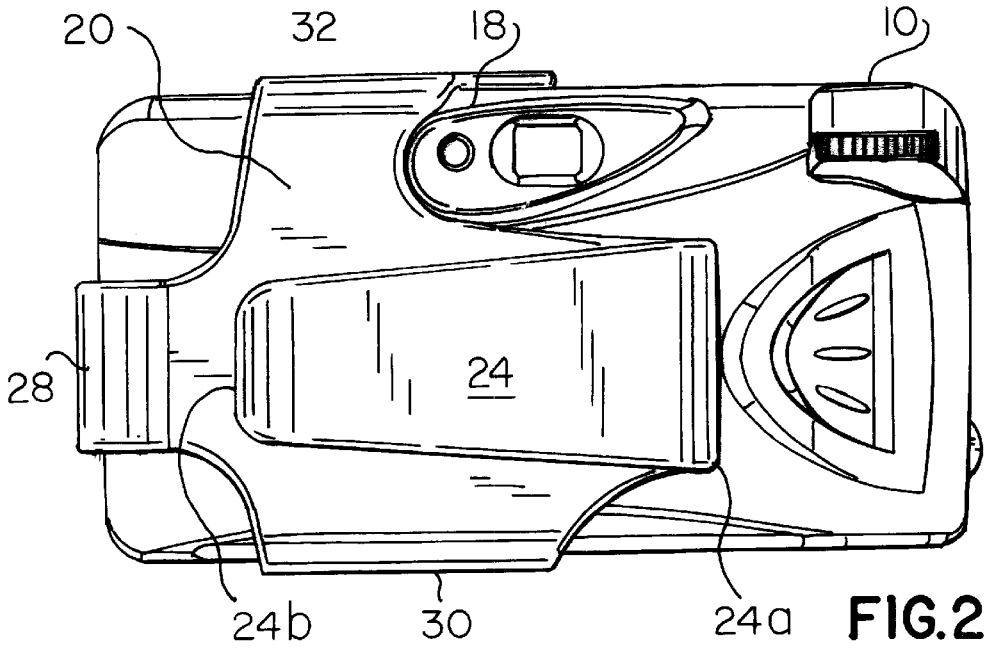
FIG. 2 is a rear plan view of a camera housed in a belt clip in accordance with one embodiment of the present invention.
Figure 3:
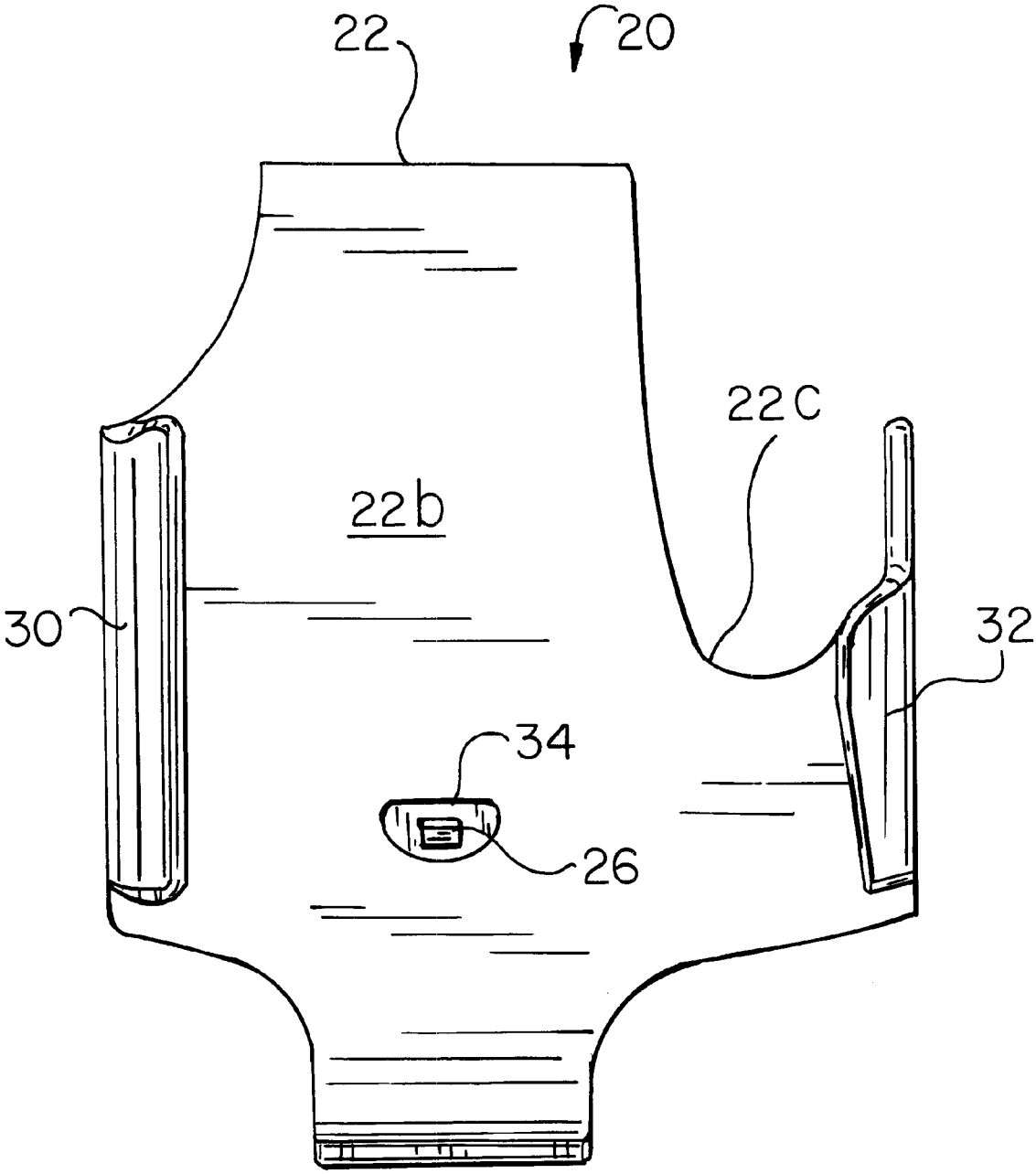
FIG. 3 is a front plan view of a belt clip in accordance with one embodiment of the present invention.
Figure 4:
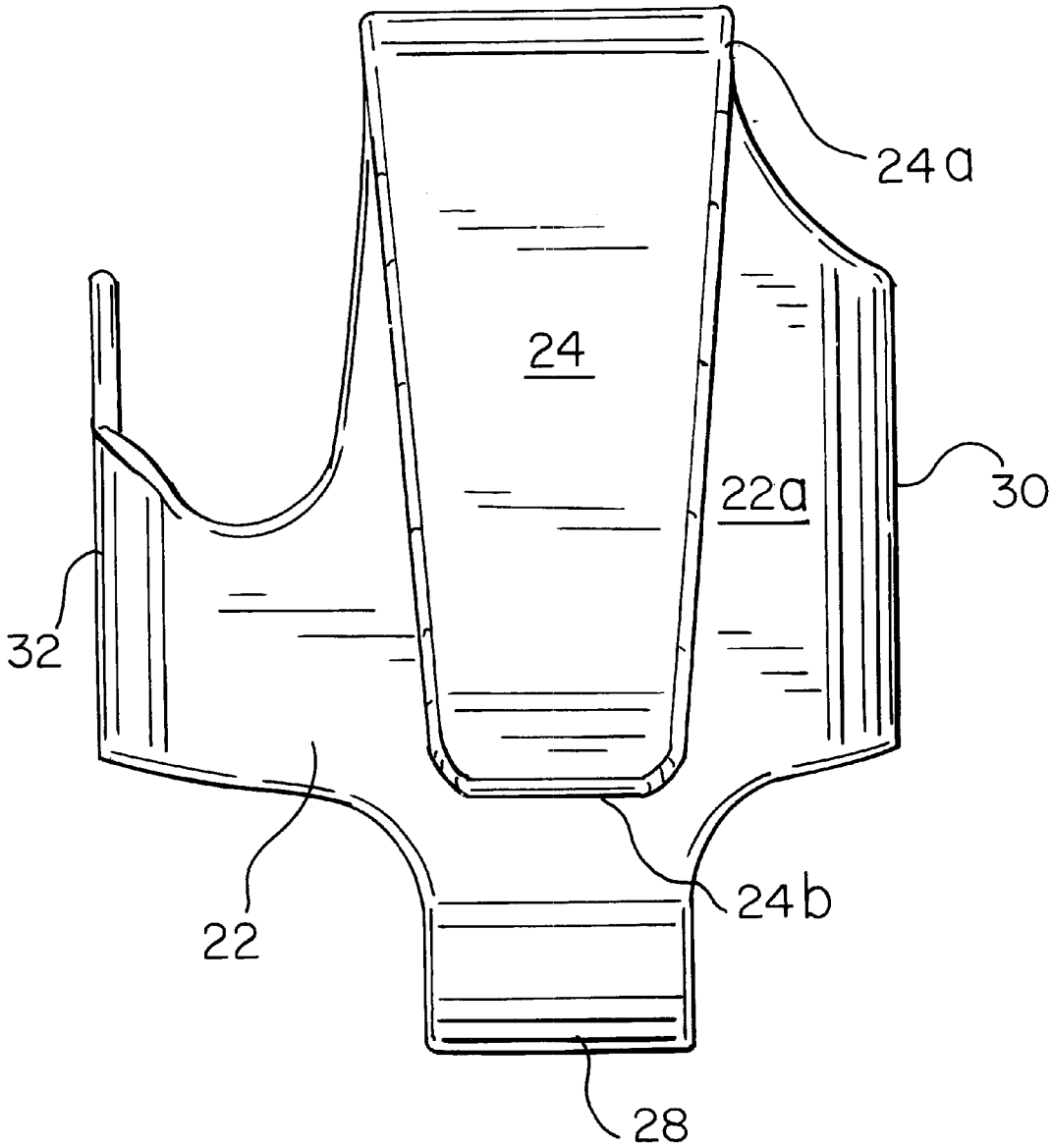
FIG. 4 is a rear plan view of the belt clip of FIG. 3.

As shown in FIGS. 1 and 2, the camera 10 mates with the holder 20 and contains only two thirds of the camera 10 in the holder 20, leaving the top of the camera 10 free to be grasped and pulled out of the holder 20. Additionally, by leaving a portion of the camera 10 free, the user may access the shutter button 14 and observe the counter window 16 while the camera 10 is still in the holder 20.

The camera 10 and holder 20 can be used such that the camera 10 and holder 20 are mated and the mated assembly placed on the garment of the user or another object. Pictures may be taken by removing the mated assembly from the garment or other object to take a picture or by removing the camera 10 from the holder 20 and using the camera 10 separately. Although the present invention may be used with many different compact cameras, it is preferably used with a lightweight camera of the single use variety. When used with a single use camera, the camera can be returned to a developer after all pictures have been taken while the user keeps the holder for use with another single use camera. Thus, the holder of the present invention can be given away as a promotional item with a single use camera, or may be sold as a separate accessory.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A holder for a portable device including a mating structure on the outer surface thereof, said holder comprising:

a main body portion including an opening therethrough, an upper end, an opposite lower end, and a pair of opposing sides;

an attachment clip attached to said upper end, said attachment clip extending down along said main body portion and terminating in a free end, said attachment clip including a prong aligned with said opening;

a support foot extending out from said lower end of said main body portion, said support foot extending out from said main body portion in generally perpendicular relation thereto;

a first retaining arm extending out from one of said sides;

a second retaining arm extending out from a second one of said sides, substantially opposite said first retaining arm; and wherein the mating structure on the portable device and said prong mate with one another via said opening when the portable device is retained in the holder.

2. The holder of claim 1, wherein said mating structure is a protuberance.

3. The holder of claim 2, wherein at least one of said first retaining arm and said second retaining arm extends around at least one side of the portable device and at least a portion of the front of the portable device.

4. The holder of claim 1, wherein at least a portion of said main body portion is contoured to cooperate with an outwardly projecting contour on the portable device when the portable device is seated within said holder.

5. The holder of claim 4, wherein at least a portion of said support foot is curved to cooperate with a curved outer surface of the portable device.

6. The holder of claim 5, wherein the portable device is a camera including a viewfinder, a counter window and a shutter button.

7. The holder of claim 6, wherein said outwardly projecting contour is defined by a portion of said viewfinder.

8. The holder of claim 7, wherein at least one of said first retaining arm and said second retaining arm is contoured so as not to obstruct the view through said viewfinder when said camera is in said holder.

9. The holder of claim 8, wherein said shutter button is unobstructed by said first and said second retaining arms when said camera is in said holder.

10. The holder of claim 9, wherein said counter window is unobstructed by said first and said second retaining arms when said camera is in said bolder.

11. A holder for a camera including a viewfinder, at least a portion of the viewfinder being contained in an outwardly projecting portion of the housing of the camera, an exposure counter window and a shutter button, the holder comprising:

a main body portion contoured to cooperate with at least a portion of the viewfinder, said main body including an upper end, an opposite lower end, and a pair of opposing sides;

an attachment clip attached to said main body portion at the upper end of said main body portion, a free end of said attachment clip contacting the outer surface of said main body portion proximal to said lower end of said main body portion;

a support foot extending out from said lower end of said main body portion proximal to and in alignment with the free end of said attachment clip, said support foot extending out from said main body portion in generally perpendicular relation thereto;

a first retaining arm extending from one side of said main body portion;

a second retaining arm extending from the other side of said main body portion;

wherein at least one of said viewfinder, said exposure counter window and said shutter button is unobstructed by said first and second retaining arms.

12. The holder of claim 11, wherein at least one of said first retaining arm and said second retaining arm extends around at least one side of the camera and at least a portion of the front of the camera.

13. The holder of claim 11, wherein at least one of said first retaining arm and said second retaining arm is contoured to cooperate with said viewfinder without obstructing the view therethrough when said camera is in said holder.

14. The holder of claim 13, wherein said shutter button is unobstructed by said first and said second retaining arms when said camera is in said holder.

15. The holder of claim 13, wherein a counter window is unobstructed by said first and said second retaining arms when said camera is in said holder.

16. The holder of claim 11, additionally including a detent mechanism for maintaining the camera in said holder.

17. The holder of claim 16, wherein said detent mechanism includes a prong located on said attachment clip and an opening through said main body portion aligned with said prong.

18. The holder of claim 17, wherein the camera additionally includes a protuberance, wherein said protuberance is aligned with said opening and said prong when the camera is retained in said holder.

19. A method of using a camera and clip for attachment to a garment or other object, comprising the steps of:

(a) providing a camera including a protuberance on the outer surface thereof;

(b) providing a camera holder, comprising, a main body portion including an upper end, an opposite lower end, and a pair of opposing sides, said main body additionally including an opening therethrough, an attachment clip attached at said upper end of said main body portion, a free end of said attachment clip contacting the outer surface of said main body portion proximal to said lower end of said back portion, said garment attachment clip including a prong aligned with said opening, a support foot attached to said main body portion at said lower end of said main body portion proximal to the free end of said attachment clip, said support foot extending out from said main body portion generally perpendicular thereto, a first retaining arm attached to a first side of said main body portion and a second retaining arm attached to a second side of said main body portion, opposite said first retaining arm;

(c) mating said camera to said holder such that said protuberance is aligned with said opening and said prong to form a mated camera assembly;

(d) securing said mated camera assembly to the garment or other object using said attachment clip;

(e) removing said mated camera assembly from the garment or other object after step (d);

(f) taking a picture using said mated camera assembly after step (e); and (g) replacing said mated camera assembly on the garment or other object after step (f).

20. The method of claim 19, further comprising the steps of unmating said camera from said mated assembly and returning said camera to a developer.

21. The method of claim 19, wherein at least a portion of said main body portion of said holder is contoured to cooperate with a portion of the housing of said camera.

* * * * *